US009799963B2

(12) United States Patent
Huang et al.

(10) Patent No.: US 9,799,963 B2
(45) Date of Patent: Oct. 24, 2017

(54) ANTENNA SYSTEM

(71) Applicant: Wistron NeWeb Corp., Hsinchu (TW)

(72) Inventors: Tsun-Che Huang, Hsinchu (TW); Cheng-Geng Jan, Hsinchu (TW); Chi-Kang Su, Hsinchu (TW)

(73) Assignee: Wistron Neweb Corp., Hsinchu (TW)

( * ) Notice: Subject to any disclaimer, the term of this patent is extended or adjusted under 35 U.S.C. 154(b) by 4 days.

(21) Appl. No.: 15/095,921

(22) Filed: Apr. 11, 2016

(65) Prior Publication Data

US 2017/0033471 A1 Feb. 2, 2017

(30) Foreign Application Priority Data

Jul. 30, 2015 (TW) ..... 104124677 A

(51) Int. Cl.

| | |
|---|---|
| ***H01Q 21/26*** | (2006.01) |
| ***H01Q 9/26*** | (2006.01) |
| ***H01Q 19/30*** | (2006.01) |
| ***H01Q 21/06*** | (2006.01) |
| ***H01Q 21/20*** | (2006.01) |

(52) U.S. Cl.

CPC ..... *H01Q 21/26* (2013.01); *H01Q 9/26* (2013.01); *H01Q 19/30* (2013.01); *H01Q 21/062* (2013.01); *H01Q 21/205* (2013.01)

(58) Field of Classification Search

None

See application file for complete search history.

(56) References Cited

U.S. PATENT DOCUMENTS

| | | | | |
|---|---|---|---|---|
| 3,836,976 | A * | 9/1974 | Monser | H01Q 21/24 343/795 |
| 6,844,851 | B2 * | 1/2005 | Yoon | H01Q 1/38 343/700 MS |
| 7,868,843 | B2 * | 1/2011 | Borau | H01Q 1/246 343/700 MS |
| 8,451,189 | B1 * | 5/2013 | Fluhler | H01Q 15/0086 343/756 |
| 2005/0179610 | A1 * | 8/2005 | Le | H01Q 1/246 343/797 |
| 2014/0139387 | A1 * | 5/2014 | Jones | H01Q 21/30 343/794 |

(Continued)

FOREIGN PATENT DOCUMENTS

| | | |
|---|---|---|
| CN | 1957506 | 5/2007 |
| CN | 103367897 | 10/2013 |

(Continued)

*Primary Examiner* — Trinh Dinh

(74) *Attorney, Agent, or Firm* — Muncy, Geissler, Olds & Lowe, P.C.

(57) ABSTRACT

An antenna system includes a system ground plane, a first antenna array, and a second antenna array. The first antenna array includes a first antenna element, a second antenna element, a third antenna element, and a fourth antenna element. The second antenna array includes a fifth antenna element, a sixth antenna element, a seventh antenna element, and an eighth antenna element. The second antenna array is disposed between the first antenna array and the system ground plane. The first antenna array has a first polarization direction. The second antenna array has a second polarization direction. The first polarization direction and the second polarization direction are orthogonal to each other.

19 Claims, 20 Drawing Sheets

(56) References Cited

U.S. PATENT DOCUMENTS

| | | | | |
|---|---|---|---|---|
| 2015/0349418 | A1* | 12/2015 | Patron | H01Q 3/24 343/836 |
| 2016/0134023 | A1* | 5/2016 | Liu | H01Q 15/242 343/756 |

FOREIGN PATENT DOCUMENTS

| | | |
|---|---|---|
| CN | 103606757 | 2/2014 |
| CN | 104143700 | 11/2014 |
| TW | 200601616 | 1/2006 |
| TW | 200849716 | 12/2008 |
| TW | M 444617 | 1/2013 |
| WO | WO 2014143320 | 9/2014 |

* cited by examiner

Intensity of Electric Field (dB)

Intensity of Electric Field (dB)

Intensity of Electric Field (dB)

Intensity of Electric Field (dB)

Intensity of Electric Field (dB)

Intensity of Electric Field (dB)

Intensity of Electric Field (dB)

Intensity of Electric Field (dB)

ANTENNA SYSTEM

CROSS REFERENCE TO RELATED APPLICATIONS

This application claims priority of Taiwan Patent Application No. 104124677 filed on Jul. 30, 2015, the entirety of which is incorporated by reference herein.

BACKGROUND OF THE INVENTION

Field of the Invention

The disclosure generally relates to an antenna system, and more particularly to an omnidirectional antenna system with multiple polarization directions.

Description of the Related Art

With the progress of mobile communication technology, mobile devices, such as portable computers, mobile phones, multimedia players, and other hybrid functional mobile devices, have become more common. To satisfy consumer demand, mobile devices can usually perform wireless communication functions. Some functions cover a large wireless communication area; for example, mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some functions cover a small wireless communication area; for example, mobile phones using Wi-Fi and Bluetooth systems and using frequency bands of 2.4 GHz, 5.2 GHz, and 5.8 GHz.

Wireless access points are indispensable elements for mobile devices in the room to connect to the Internet at a high speed. However, since the indoor environment has serious signal reflection and multipath fading, wireless access points should process signals in a variety of polarization directions and from a variety of transmission directions simultaneously. Accordingly, it becomes a critical challenge for antenna designers to design an omnidirectional antenna with multiple polarization directions in the limited space of wireless access points.

BRIEF SUMMARY OF THE INVENTION

In a preferred embodiment, the disclosure is directed to an antenna system including a system ground plane, a first antenna array, and a second antenna array. The first antenna array includes a first antenna element, a second antenna element, a third antenna element, and a fourth antenna element. The second antenna array includes a fifth antenna element, a sixth antenna element, a seventh antenna element, and an eighth antenna element. The second antenna array is disposed between the first antenna array and the system ground plane. The first antenna array has a first polarization direction. The second antenna array has a second polarization direction. The first polarization direction and the second polarization direction are orthogonal to each other.

In some embodiments, the first antenna element, the second antenna element, the third antenna element, and the fourth antenna element have identical structures, and are symmetrical with respect to a central point of the first antenna array.

In some embodiments, the first antenna element, the second antenna element, the third antenna element, and the fourth antenna element are all dipole antennas.

In some embodiments, the first antenna element, the second antenna element, the third antenna element, and the fourth antenna element are respectively disposed at the four edges of a square.

In some embodiments, the first antenna array further includes a first director, a second director, a third director, and a fourth director, which are configured to respectively guide electromagnetic waves of the first antenna element, the second antenna element, the third antenna element, and the fourth antenna element outwardly.

In some embodiments, the first antenna array further includes a first reflector, a second reflector, a third reflector, and a fourth reflector, which are configured to respectively reflect electromagnetic waves of the first antenna element, the second antenna element, the third antenna element, and the fourth antenna element outwardly.

In some embodiments, the first antenna element, the second antenna element, the third antenna element, and the fourth antenna element are all folded dipole antennas.

In some embodiments, the first antenna array further includes a first switch circuit, a second switch circuit, a third switch circuit, and a fourth switch circuit, such that the first antenna array operates in a directional mode or an omnidirectional mode.

In some embodiments, the first switch circuit, the second switch circuit, the third switch circuit, and the fourth switch circuit are all PIN diodes.

In some embodiments, each of the first switch circuit, the second switch circuit, the third switch circuit, and the fourth switch circuit is coupled between a central feeding point and a respective one of the first antenna element, the second antenna element, the third antenna element, and the fourth antenna element.

In some embodiments, the first switch circuit, the second switch circuit, the third switch circuit, and the fourth switch circuit are respectively embedded in the first reflector, the second reflector, the third reflector, and the fourth reflector.

In some embodiments, the first antenna element, the second antenna element, the third antenna element, and the fourth antenna element are disposed on a first substrate. The fifth antenna element and the seventh antenna element are disposed on a second substrate. The sixth antenna element and the eighth antenna element are disposed on a third substrate. The first substrate, the second substrate, and the third substrate are perpendicular to each other.

In some embodiments, the fifth antenna element, the sixth antenna element, the seventh antenna element, and the eighth antenna element have identical structures, and are symmetrical with respect to a central point of the second antenna array.

In some embodiments, the fifth antenna element, the sixth antenna element, the seventh antenna element, and the eighth antenna element are all monopole antennas.

In some embodiments, the fifth antenna element, the sixth antenna element, the seventh antenna element, and the eighth antenna element are all PIFAs (Planar Inverted F Antennas).

In some embodiments, the second antenna array further includes a fifth reflector, a sixth reflector, a seventh reflector, and an eighth reflector, which are configured to respectively reflect electromagnetic waves of the fifth antenna element, the sixth antenna element, the seventh antenna element, and the eighth antenna element outwardly.

In some embodiments, the fifth reflector, the sixth reflector, the seventh reflector, and the eighth reflector are all coupled to the system ground plane.

In some embodiments, the first antenna array is substantially parallel to the system ground plane, and the second antenna array is substantially perpendicular to the system ground plane.

In some embodiments, the first antenna array and the second antenna array operate in a low-frequency band from about 2400 MHz to about 2500 MHz. The spacing between the first antenna array and the system ground plane is substantially equal to 0.125 wavelength of a central operation frequency of the low-frequency band.

In some embodiments, the first antenna array and the second antenna array operate in a high-frequency band from about 4900 MHz to about 5950 MHz. The spacing between the first antenna array and the system ground plane is substantially equal to 0.25 wavelength of a central operation frequency of the high-frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Figure 1:
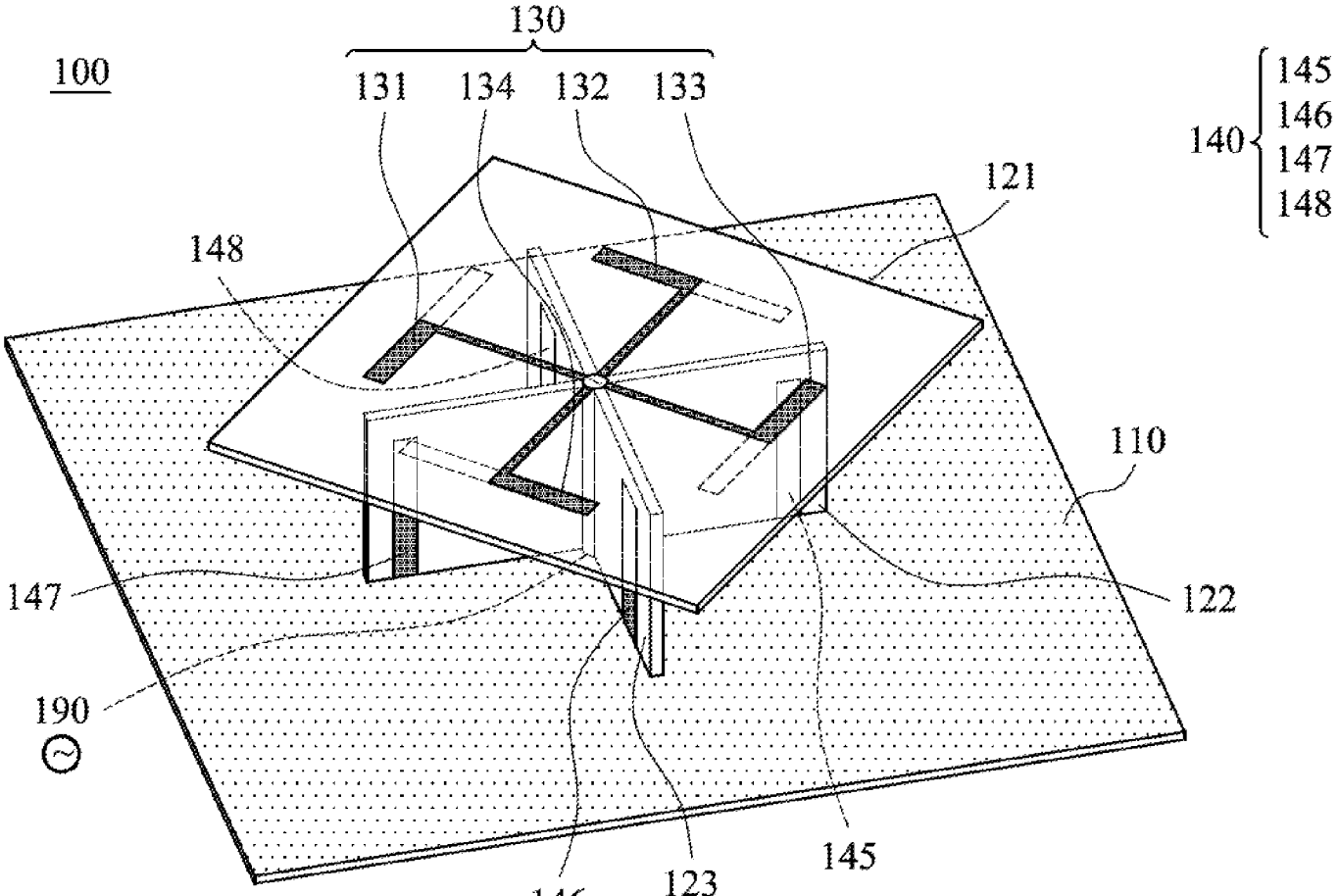
FIG. 1 is a diagram of an antenna system according to an embodiment of the invention.

FIG. 1 is a diagram of an antenna system 100 according to an embodiment of the invention. The antenna system 100 may be applied in a wireless access point and configured to provide an almost omnidirectional radiation pattern. As shown in FIG. 1, the antenna system 100 includes a system ground plane 110, a first antenna array 130, and a second antenna array 140. The system ground plane 110 may be a metal ground plane of a wireless access point, and it may be used to provide a ground voltage VSS. The second antenna array 140 is disposed between the first antenna array 130 and the system ground plane 110. Both of the first antenna array 130 and the second antenna array 140 are excited by a signal source 190. The first antenna array 130 includes a first antenna element 131, a second antenna element 132, a third antenna element 133, and a fourth antenna element 134. The second antenna array 140 includes a fifth antenna element 145, a sixth antenna element 146, a seventh antenna element 147, and an eighth antenna element 148. More specifically, the antenna system includes a first substrate 121, a second substrate 122, and a third substrate 123. The first antenna element 131, the second antenna element 132, the third antenna element 133, and the fourth antenna element 134 are disposed on the first substrate 121. The fifth antenna element 145 and the seventh antenna element 147 are disposed on the second substrate 122. The sixth antenna element 146 and the eighth antenna element 148 are disposed on the third substrate 123. The first substrate 121, the second substrate 122, and the third substrate 123 are perpendicular to each other, and their arrangement is similar to an X-plane, a Y-plane, and a Z-plane in a coordinate system. It should be noted that the aforementioned antenna elements form a ring-shaped configuration, and therefore the antenna system 100 has an almost omnidirectional radiation pattern. In addition, the first antenna array 130 has a first polarization direction, and the second antenna array 140 has a second polarization direction. The first polarization direction and the second polarization direction are orthogonal to each other. For example, the first polarization direction may be a horizontal polarization direction (e.g., parallel to an X-axis direction or a Y-axis direction), and the second polarization direction may be a vertical polarization direction (e.g., parallel to a Z-axis direction). With such a design, the omnidirectional antenna system 100 can receive or transmit signals in a variety of polarization directions.

The detailed structures of the first antenna array and the second antenna array will be described in the following embodiments. It should be understood that these embodiments are just exemplary, instead of limitations of the patent scope of the present application.

Figure 2A:
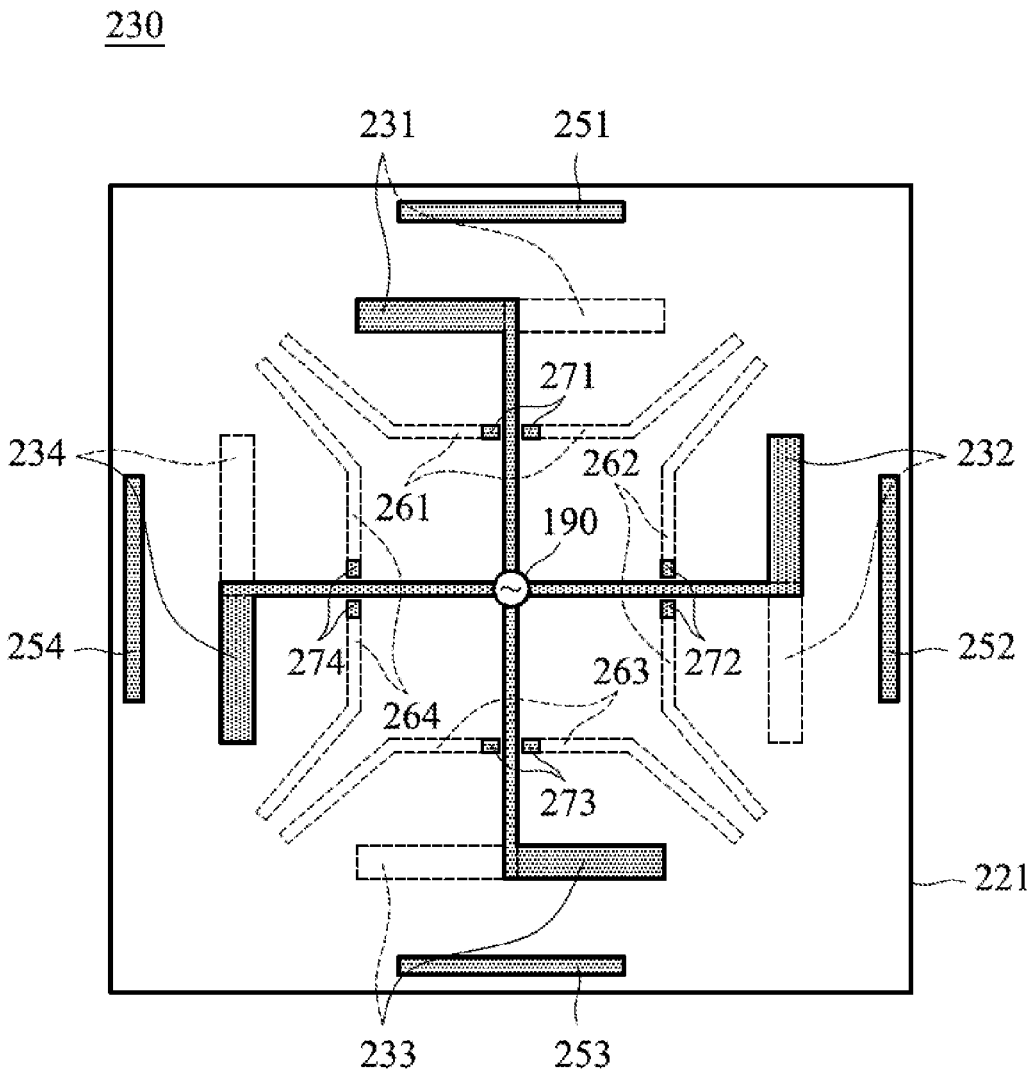
FIG. 2A is a perspective view of a first antenna array according to an embodiment of the invention.
Figure 2B:
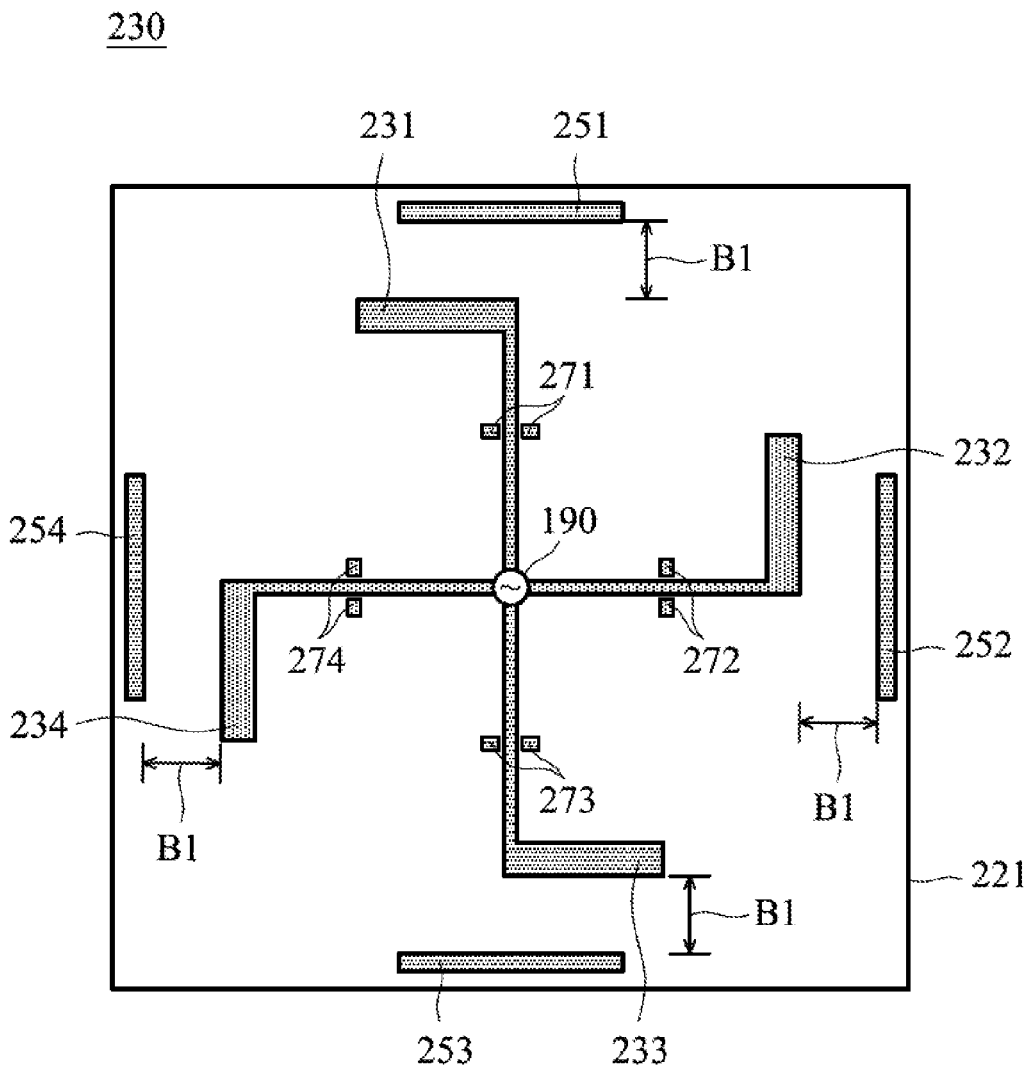
FIG. 2B is a front view of a first antenna array according to an embodiment of the invention.
Figure 2C:
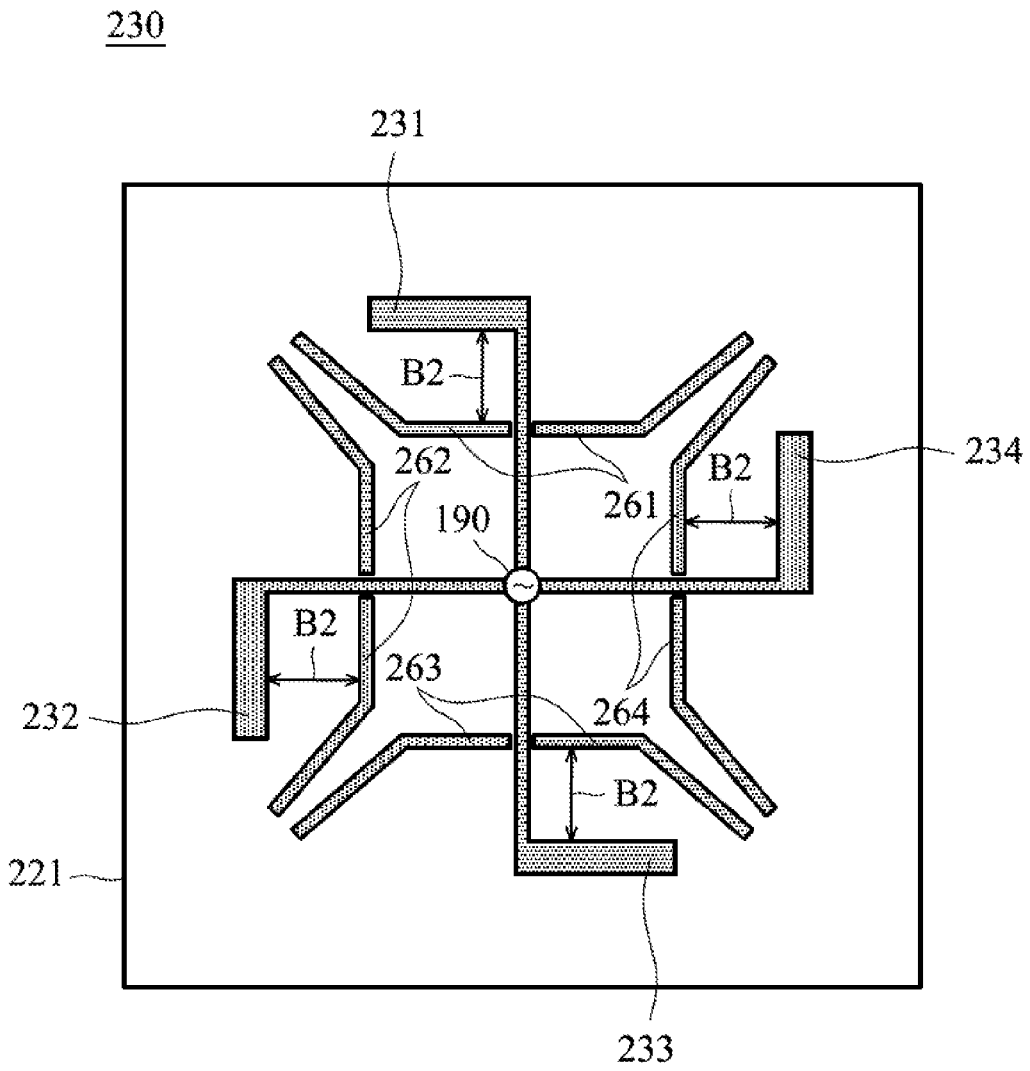
FIG. 2C is a rear view of a first antenna array according to an embodiment of the invention.

FIG. 2A is a perspective view of a first antenna array 230 according to an embodiment of the invention. FIG. 2B is a front view of the first antenna array 230 according to an embodiment of the invention. FIG. 2C is a rear view of the first antenna array 230 according to an embodiment of the invention. Please refer to FIG. 2A, FIG. 2B, and FIG. 2C together. The first antenna array 230 includes a first antenna element 231, a second antenna element 232, a third antenna element 233, a fourth antenna element 234, a first director 251, a second director 252, a third director 253, a fourth director 254, a first reflector 261, a second reflector 262, a third reflector 263, and a fourth reflector 264. Each antenna element is disposed between a respective director and a respective reflector. In the embodiment of FIG. 2A, FIG. 2B, and FIG. 2C, the first antenna element 231, the second antenna element 232, the third antenna element 233, and the fourth antenna element 234 are all dipole antennas. Each dipole antenna includes a positive branch and a negative branch, which are respectively disposed on an upper surface and a lower surface of a first substrate 221. Each of the positive branch and the negative branch has a straight-line shape. The first antenna element 231, the second antenna element 232, the third antenna element 233, and the fourth antenna element 234 have identical structures, and are symmetrical with respect to a central point of the first antenna array 230. The length of each antenna element is substantially equal to 0.5 wavelength of a central operation frequency of the first antenna array 230. Specifically, the first antenna element 231, the second antenna element 232, the third antenna element 233, and the fourth antenna element 234 are respectively disposed at the four edges of the square first substrate 221. The first director 251, the second director 252, the third director 253, and the fourth director 254 are configured to respectively guide electromagnetic waves of the first antenna element 231, the second antenna element 232, the third antenna element 233, and the fourth antenna element 234 outwardly. Each director substantially has a straight-line shape. The length of each director is from 0.25 wavelength to 0.5 wavelength of the central operation frequency of the first antenna array 230. The spacing B1 between each director and its respective adjacent antenna element is from 0.15 wavelength to 0.25 wavelength of the central operation frequency of the first antenna array 230. The first reflector 261, the second reflector 262, the third reflector 263, and the fourth reflector 264 are configured to respectively reflect the electromagnetic waves of the first antenna element 231, the second antenna element 232, the third antenna element 233, and the fourth antenna element 234 outwardly. Each reflector substantially has a U-shape. Each reflector includes a first portion and a second portion. The first portion and the second portion are disposed on the lower surface of the first substrate 221. The end points of the first portion and the second portion are connected to each other on the upper surface of the first substrate 221 through two via elements (271, 272, 273, and 274). The length of each reflector is from 0.5 wavelength to 1 wavelength of the central operation frequency of the first antenna array 230. The spacing B2 between each reflector and its respective adjacent antenna element is from 0.15 wavelength to 0.25 wavelength of the central operation frequency of the first antenna array 230. It should be noted that the aforementioned directors and reflectors are optional elements for enhancing the gain of the first antenna array 230. In alternative embodiments, the directors and reflectors may be removed from the first antenna array 230.

Figure 3A:
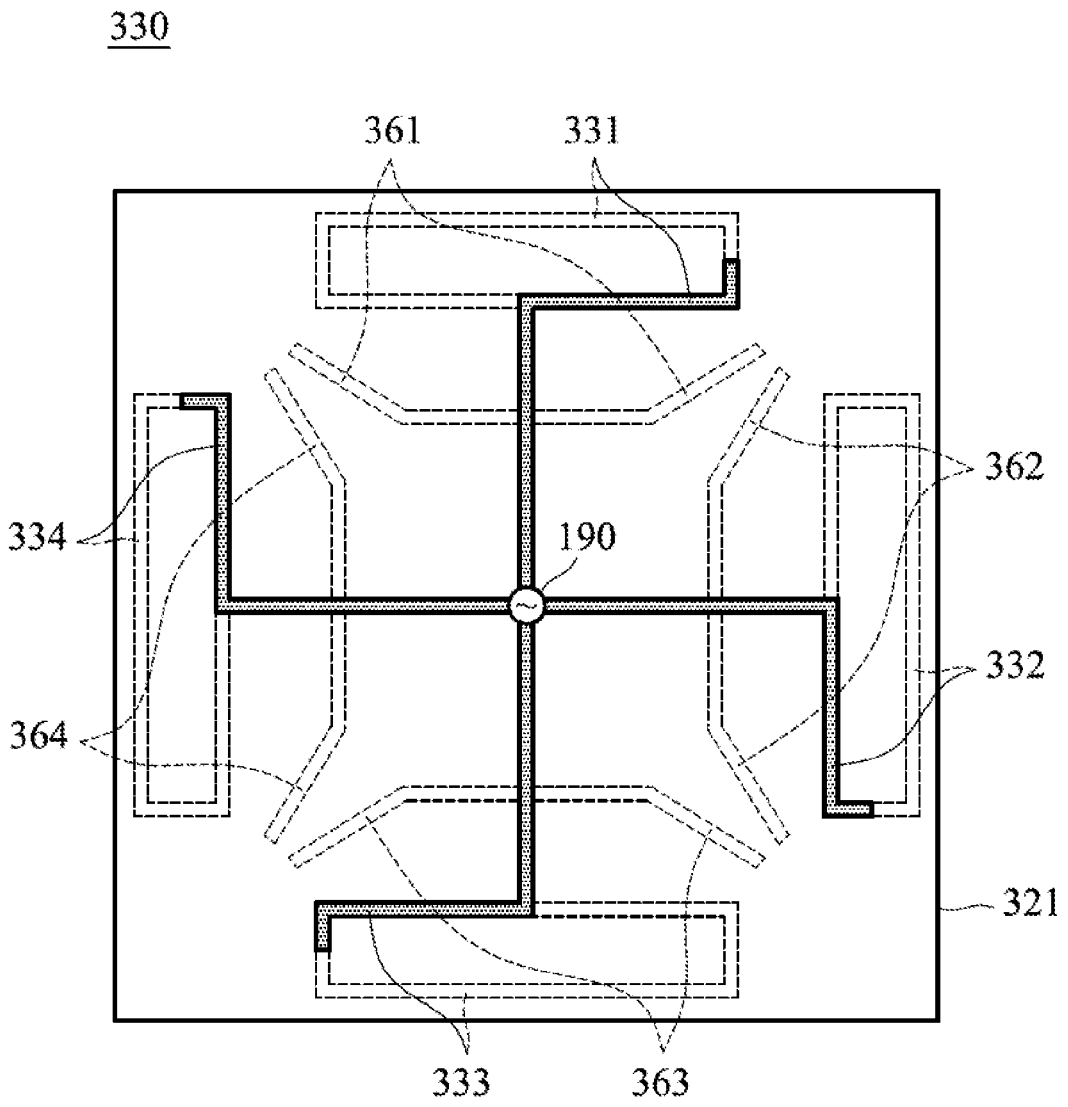
FIG. 3A is a perspective view of a first antenna array according to an embodiment of the invention.
Figure 3B:
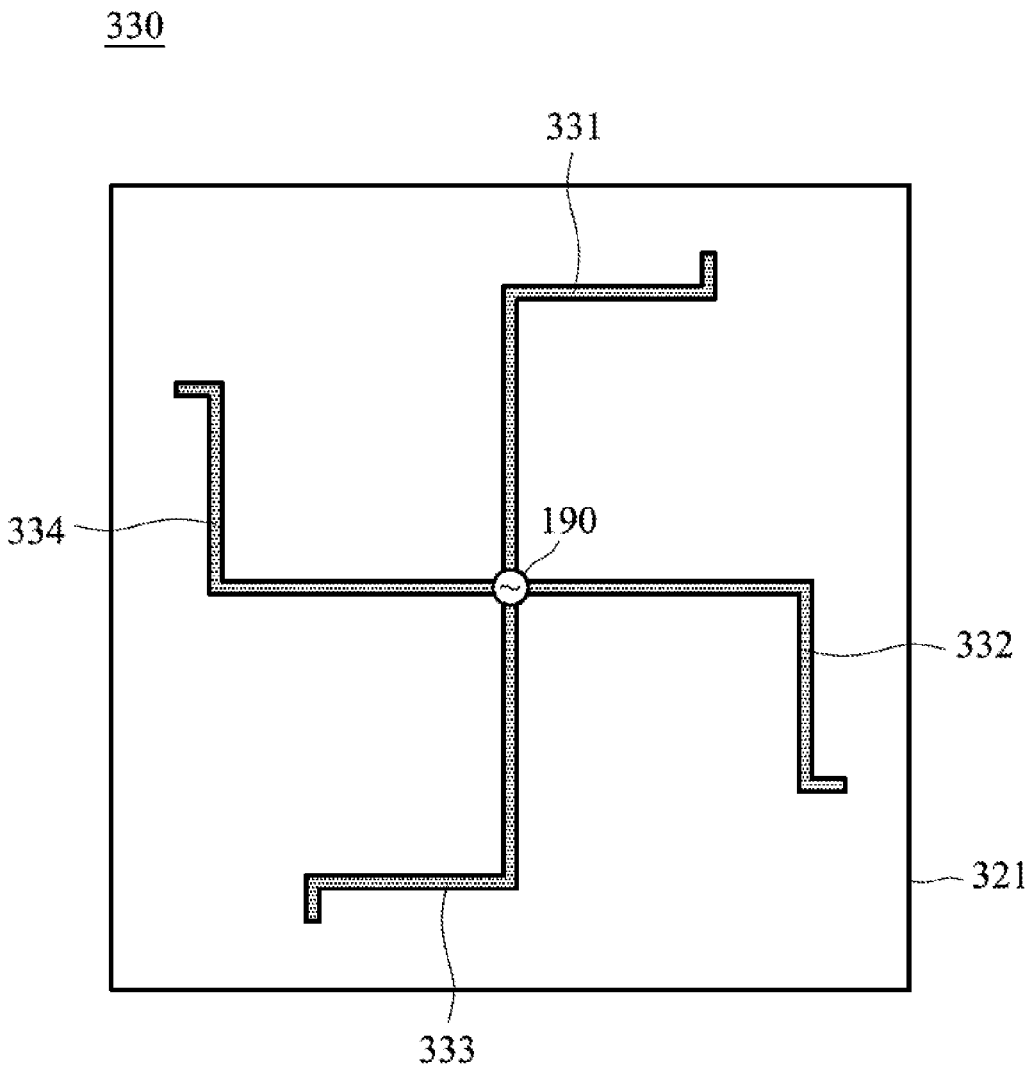
FIG. 3B is a front view of a first antenna array according to an embodiment of the invention.
Figure 3C:
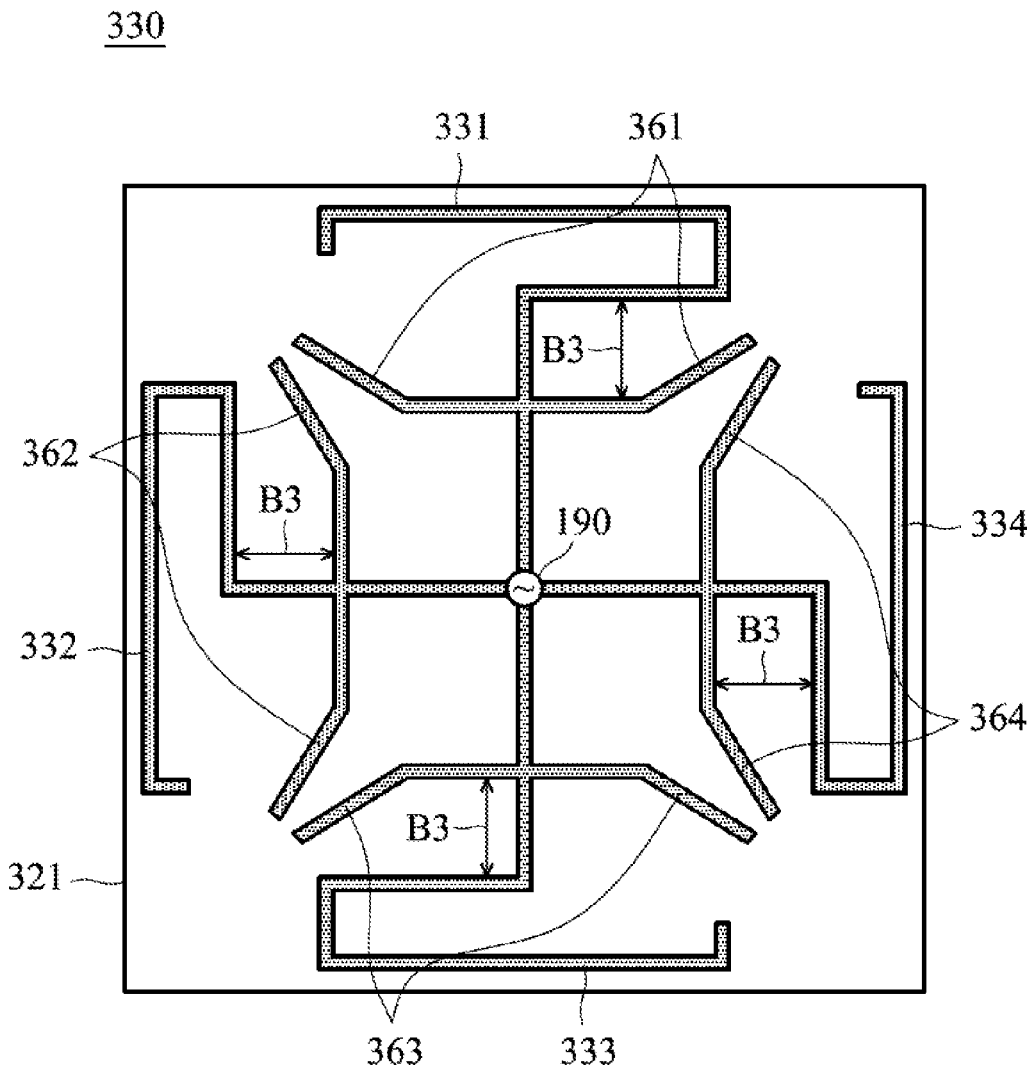
FIG. 3C is a rear view of a first antenna array according to an embodiment of the invention.

FIG. 3A is a perspective view of a first antenna array 330 according to an embodiment of the invention. FIG. 3B is a front view of the first antenna array 330 according to an embodiment of the invention. FIG. 3C is a rear view of the first antenna array 330 according to an embodiment of the invention. Please refer to FIG. 3A, FIG. 3B, and FIG. 3C together. The first antenna array 330 includes a first antenna element 331, a second antenna element 332, a third antenna element 333, a fourth antenna element 334, a first reflector 361, a second reflector 362, a third reflector 363, and a fourth reflector 364. In the embodiment of FIG. 3A, FIG. 3B, and FIG. 3C, the first antenna element 331, the second antenna element 332, the third antenna element 333, and the fourth antenna element 334 are all folded dipole antennas. Each folded dipole antenna includes a positive branch and a negative branch, which are respectively disposed on an upper surface and a lower surface of a first substrate 321. The positive branch is substantially a quarter (¼) loop structure. The negative branch is substantially a three-quarters (¾) loop structure. The aforementioned loop structure may substantially have a hollow rectangular shape. The first antenna element 331, the second antenna element 332, the third antenna element 333, and the fourth antenna element 334 have identical structures, and are symmetrical with respect to a central point of the first antenna array 330. The length of each antenna element is substantially equal to 0.5 wavelength of a central operation frequency of the first antenna array 330. Specifically, the first antenna element 331, the second antenna element 332, the third antenna element 333, and the fourth antenna element 334 are respectively disposed at the four edges of the square first substrate 321. The first reflector 361, the second reflector 362, the third reflector 363, and the fourth reflector 364 are configured to respectively reflect electromagnetic waves of the first antenna element 331, the second antenna element 332, the third antenna element 333, and the fourth antenna element 334 outwardly. Each reflector substantially has a U-shape. Each reflector includes a first portion and a second portion. The first portion and the second portion are both disposed on the lower surface of the first substrate 321. The end points of the first portion and the second portion are coupled to a respective antenna feeding line on the lower surface of the first substrate 321. The length of each reflector is from 0.5 wavelength to 1 wavelength of the central operation frequency of the first antenna array 330. The spacing B3 between each reflector and its respective adjacent antenna element is from 0.15 wavelength to 0.25 wavelength of the central operation frequency of the first antenna array 330. It should be noted that the aforementioned reflectors are optional elements for enhancing the gain of the first antenna array 330. In alternative embodiments, the reflectors may be removed from the first antenna array 330.

Figure 4:
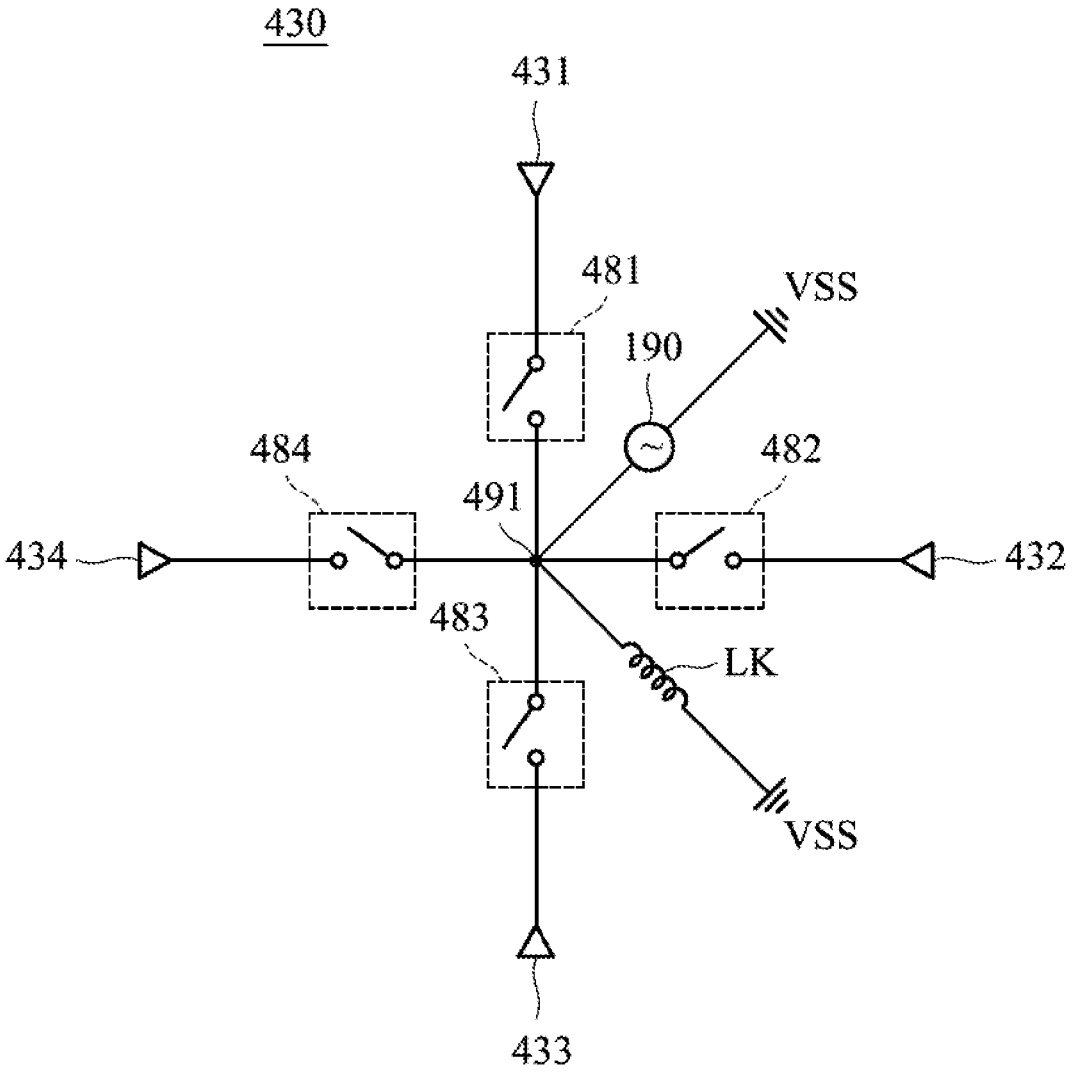
FIG. 4 is a diagram of a first antenna array according to an embodiment of the invention.

FIG. 4 is a diagram of a first antenna array 430 according to an embodiment of the invention. The first antenna array 430 includes a first antenna element 431, a second antenna element 432, a third antenna element 433, a fourth antenna element 434, a first switch circuit 481, a second switch circuit 482, a third switch circuit 483, and a fourth switch circuit 484. Each of the first switch circuit 481, the second switch circuit 482, the third switch circuit 483, and the fourth switch circuit 484 is coupled between a central feeding point 491 and a respective one of the first antenna element 431, the second antenna element 432, the third antenna element 433, and the fourth antenna element 434. A signal source 190 is coupled between the central feeding point 491 and a ground voltage VSS, and is configured to excite the first antenna array 430. A choke inductor LK is coupled between the central feeding point 491 and the ground voltage VSS, and is configured to pass DC (Direct Current) signals and block AC (Alternating Current) signals. The equivalent inductance of the choke inductor LK is greater than 100 nH. The aforementioned switch circuits are configured to control the first antenna array 430 to operate in a directional mode or an omnidirectional mode. For example, when all of the switch circuits are closed, the first antenna array 430 operates in the omnidirectional mode; and when any of the switch circuits is opened, the first antenna array 430 operates in the directional mode. The radiation pattern of the first antenna array 430 is adjustable by controlling the aforementioned switch circuits. In some embodiments, the first switch circuit 481, the second switch circuit 482, the third switch circuit 483, and the fourth switch circuit 484 are all PIN diodes. For example, each PIN diode has an anode coupled to a respective antenna element, and a cathode coupled to the central feeding point 491. The aforementioned PIN diodes can be selectively closed or opened according to a DC signal, such that the first antenna array 430 can switch between the omnidirectional mode and the directional mode.

Figure 5:
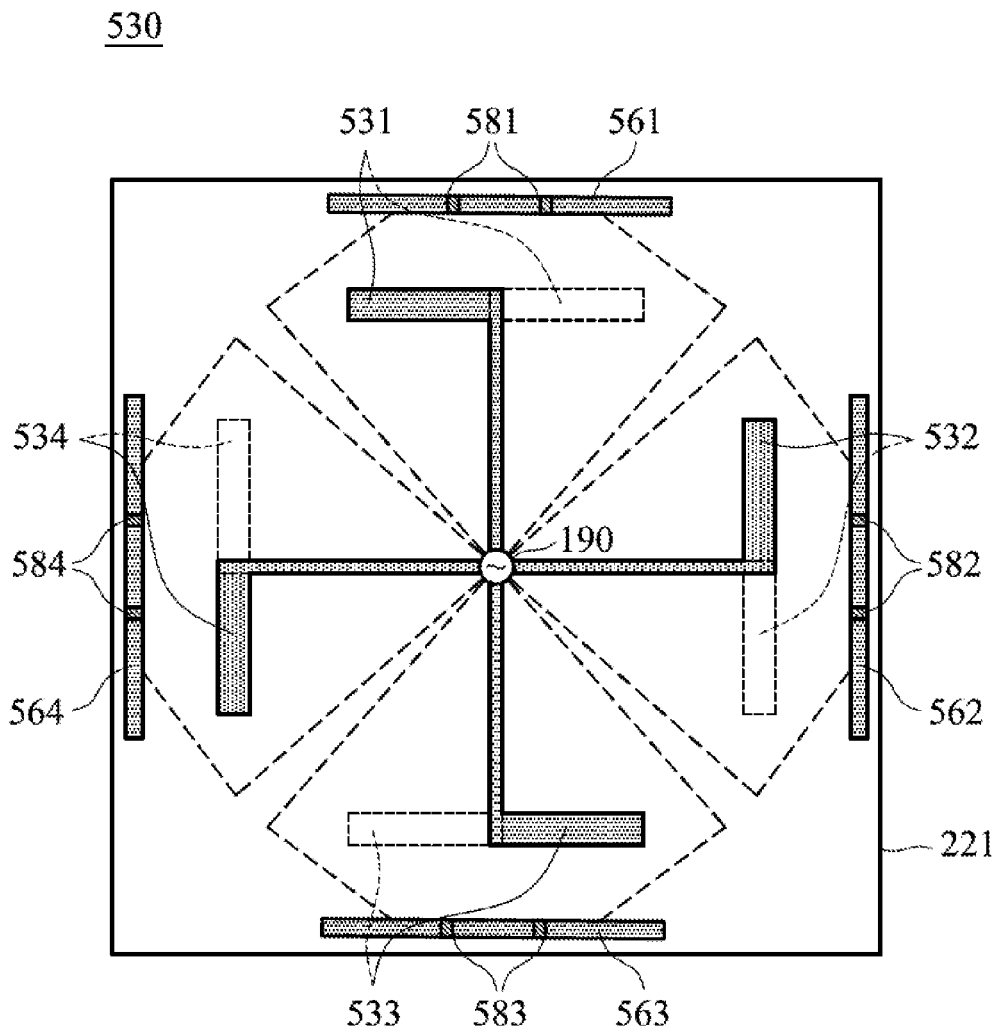
FIG. 5 is a diagram of a first antenna array according to an embodiment of the invention.

FIG. 5 is a diagram of a first antenna array 530 according to an embodiment of the invention. The first antenna array 530 includes a first antenna element 531, a second antenna element 532, a third antenna element 533, a fourth antenna element 534, a first reflector 561, a second reflector 562, a third reflector 563, a fourth reflector 564, a first switch circuit 581, a second switch circuit 582, a third switch circuit 583, and a fourth switch circuit 584. The difference from the above embodiments is that the reflectors are all disposed at the outermost periphery of the first antenna array 530. The first switch circuit 581, the second switch circuit 582, the third switch circuit 583, and the fourth switch circuit 584 are respectively embedded in the first reflector 561, the second reflector 562, the third reflector 563, and the fourth reflector 564. A signal source 190 is coupled between a central feeding point 591 and a ground voltage VSS, and is configured to excite the first antenna array 530. A choke inductor LK is coupled between the central feeding point 591 and the ground voltage VSS, and is configured to pass DC signals and block AC signals. The equivalent inductance of the choke inductor LK is greater than 100 nH. The aforementioned switch circuits are configured to adjust the effective resonant lengths of the aforementioned reflectors, thereby controlling the first antenna array 530 to operate in a directional mode or an omnidirectional mode. For example, when the first switch circuit 581 is closed, the effective resonant length of the first reflector 561 increases (e.g., longer than 0.5 wavelength of a central operation frequency of the first antenna array 530), such that the first reflector 561 rejects the electromagnetic waves from the first antenna element 531; and when the first switch circuit 581 is opened, the effective resonant length of the first reflector 561 decreases (e.g., shorter than 0.5 wavelength of the central operation frequency of the first antenna array 530), such that the first reflector 561 guides the electromagnetic waves from the first antenna element 531 outwardly. The operation theory of the other switch circuits and reflectors are similar to the above. With such a design, when all of the switch circuits are opened, the first antenna array 530 operates in the omnidirectional mode; and when any of the switch circuits is closed, the first antenna array 530 operates in the directional mode. The radiation pattern of the first antenna array 530 is adjustable by controlling the aforementioned switch circuits. In some embodiments, the first switch circuit 581, the second switch circuit 582, the third switch circuit 583, and the fourth switch circuit 584 are all PIN diodes. The aforementioned PIN diodes can be selectively closed or opened according to a DC signal, such that the first antenna array 530 can switch between the omnidirectional mode and the directional mode.

Figure 6A:
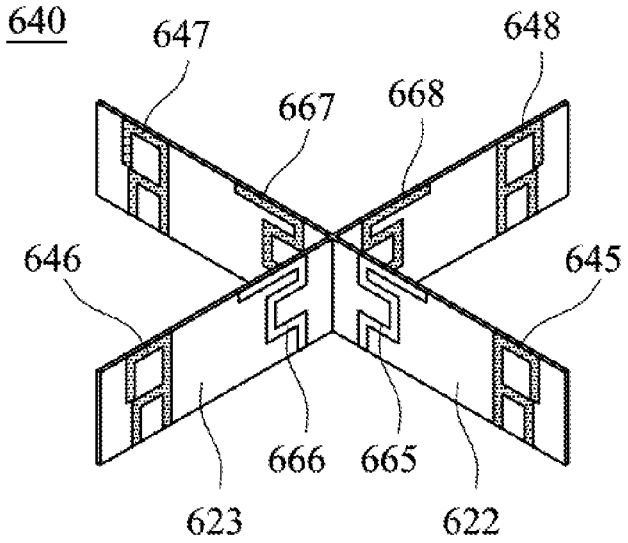
FIG. 6A is a perspective view of a second antenna array according to an embodiment of the invention.
Figure 6B:
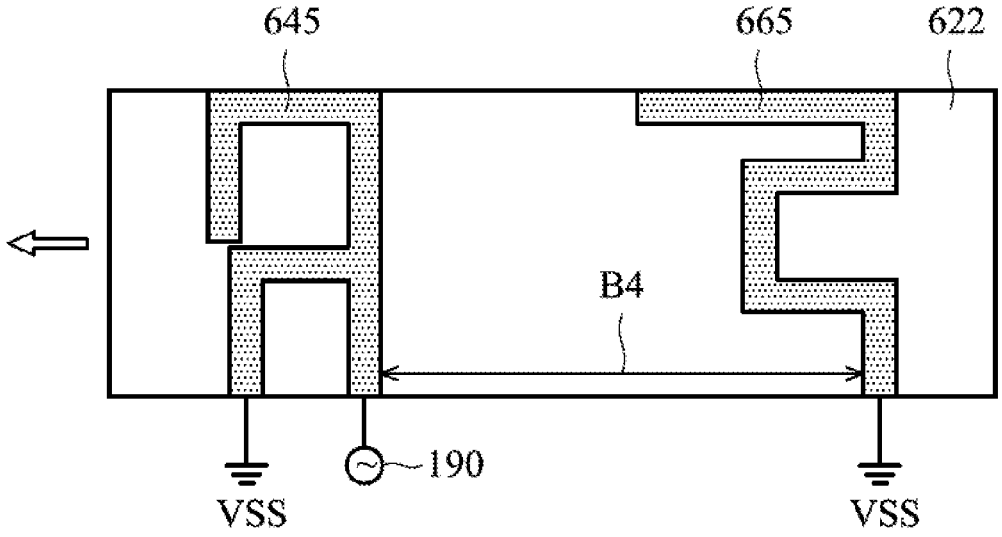
FIG. 6B is a partial side view of a second antenna array according to an embodiment of the invention.

FIG. 6A is a perspective view of a second antenna array 640 according to an embodiment of the invention. FIG. 6B is a partial side view of the second antenna array 640 according to an embodiment of the invention. Please refer to FIG. 6A and FIG. 6B together. The second antenna array 640 includes a fifth antenna element 645, a sixth antenna element 646, a seventh antenna element 647, an eighth antenna element 648, a fifth reflector 665, a sixth reflector 666, a seventh reflector 667, and an eighth reflector 668. In the embodiment of FIG. 6A and FIG. 6B, the fifth antenna element 645, the sixth antenna element 646, the seventh antenna element 647, and the eighth antenna element 648 are all PIFAs (Planar Inverted F Antennas). The fifth antenna element 645, the sixth antenna element 646, the seventh antenna element 647, and the eighth antenna element 648 have identical structures, and are symmetrical with respect to a central point of the second antenna array 640. Specifically, the fifth antenna element 645 and the seventh antenna element 647 are respectively disposed at two opposite edges of a second substrate 622. The sixth antenna element 646 and the eighth antenna element 648 are respectively disposed at two opposite edges of a third substrate 623. The second substrate 622 and the third substrate 623 are perpendicular to each other. The fifth reflector 665, the sixth reflector 666, the seventh reflector 667, and the eighth reflector 668 are configured to respectively reflect electromagnetic waves of the fifth antenna element 645, the sixth antenna element 646, the seventh antenna element 647, and the eighth antenna element 648 outwardly. The fifth reflector 665, the sixth reflector 666, the seventh reflector 667, and the eighth reflector 668 are all coupled to a ground voltage VSS, which is provided by a system ground plane. Each reflector substantially has a Z-shape. The length of each reflector is from 0.5 wavelength to 1 wavelength of a central operation frequency of the second antenna array 640. The spacing B4 between each reflector and its respective adjacent antenna element is from 0.15 wavelength to 0.25 wavelength of the central operation frequency of the second antenna array 640. It should be noted that the aforementioned reflectors are optional elements for enhancing the gain of the second antenna array 640. In alternative embodiments, the reflectors may be removed from the second antenna array 640.

Figure 7A:
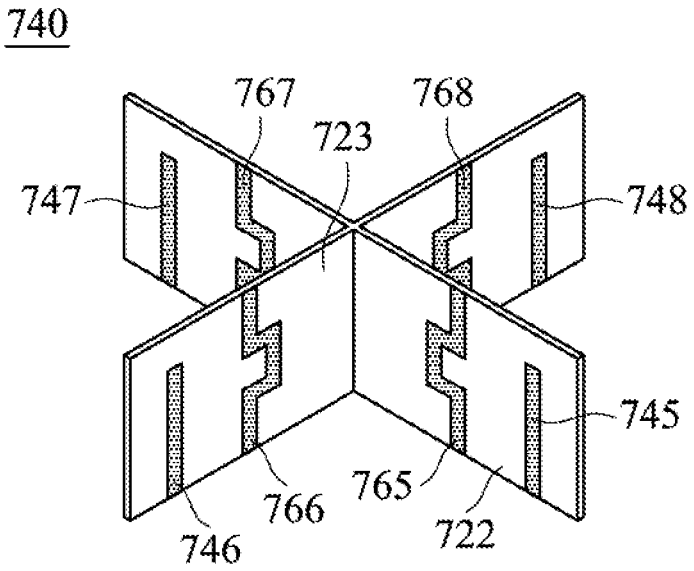
FIG. 7A is a perspective view of a second antenna array according to an embodiment of the invention.
Figure 7B:
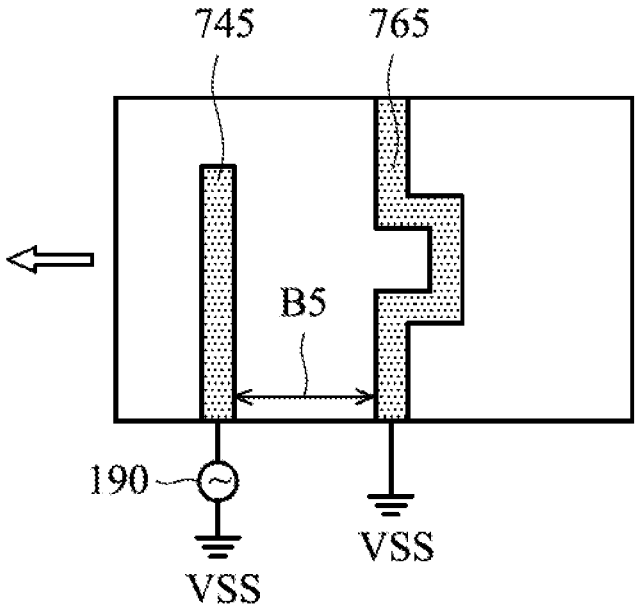
FIG. 7B is a partial side view of a second antenna array according to an embodiment of the invention.

FIG. 7A is a perspective view of a second antenna array 740 according to an embodiment of the invention. FIG. 7B is a partial side view of the second antenna array 740 according to an embodiment of the invention. Please refer to FIG. 7A and FIG. 7B together. The second antenna array 740 includes a fifth antenna element 745, a sixth antenna element 746, a seventh antenna element 747, an eighth antenna element 748, a fifth reflector 765, a sixth reflector 766, a seventh reflector 767, and an eighth reflector 768. In the embodiment of FIG. 7A and FIG. 7B, the fifth antenna element 745, the sixth antenna element 746, the seventh antenna element 747, and the eighth antenna element 748 are all monopole antennas. Each monopole antenna substantially has a straight-line shape. The fifth antenna element 745, the sixth antenna element 746, the seventh antenna element 747, and the eighth antenna element 748 have identical structures, and are symmetrical with respect to a central point of the second antenna array 740. Specifically, the fifth antenna element 745 and the seventh antenna element 747 are respectively disposed at two opposite edges of a second substrate 722. The sixth antenna element 746 and the eighth antenna element 748 are respectively disposed at two opposite edges of a third substrate 723. The second substrate 722 and the third substrate 723 are perpendicular to each other. The fifth reflector 765, the sixth reflector 766, the seventh reflector 767, and the eighth reflector 768 are configured to respectively reflect electromagnetic waves of the fifth antenna element 745, the sixth antenna element 746, the seventh antenna element 747, and the eighth antenna element 748 outwardly. The fifth reflector 765, the sixth reflector 766, the seventh reflector 767, and the eighth reflector 768 are all coupled to a ground voltage VSS, which is provided by a system ground plane. Each reflector substantially has an inverted U-shape. A central portion of each reflector defines a rectangular notch, and two ends of each reflector extend toward opposite directions. The length of each reflector is from 0.5 wavelength to 1 wavelength of a central operation frequency of the second antenna array 740. The spacing B5 between each reflector and its respective adjacent antenna element is from 0.15 wavelength to 0.25 wavelength of the central operation frequency of the second antenna array 740. It should be noted that the aforementioned reflectors are optional elements for enhancing the gain of the second antenna array 740. In alternative embodiments, the reflectors may be removed from the second antenna array 740.

It should be understood that the second antenna array may further include a fifth switch circuit, a sixth switch circuit, a seventh switch circuit, and an eighth switch circuit, as mentioned in the embodiment of FIG. 4 and FIG. 5, and therefore the second antenna array can operate in a directional mode or an omnidirectional mode. Such a configuration has a similar operation theory to that of the embodiment of FIG. 4 and FIG. 5, and it will not be described again here.

Figure 8:
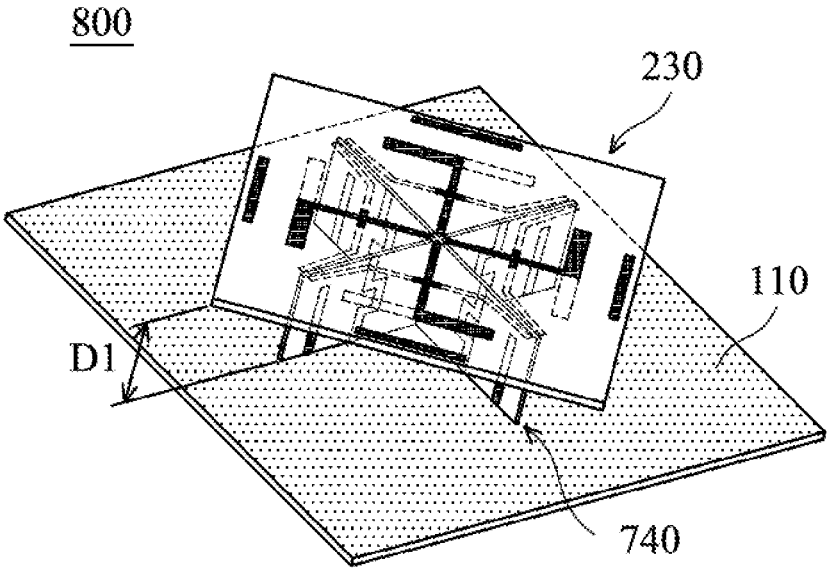
FIG. 8 is a diagram of an antenna system according to an embodiment of the invention.

FIG. 8 is a diagram of an antenna system 800 according to an embodiment of the invention. The antenna system 800 is a combination of the system ground plane 110, the first antenna array 230 (the embodiment of FIG. 2A, FIG. 2B, and FIG. 2C), and the second antenna array 740 (the embodiment of FIG. 7A and FIG. 7B). The first antenna array 230 is substantially parallel to the system ground plane 110. The second antenna array 740 is substantially perpendicular to the system ground plane 110. In the embodiment of FIG. 8, the first antenna array 230 and the second antenna array 740 both operate in a high-frequency band from about 4900 MHz to about 5950 MHz. The spacing D1 between the first antenna array 230 and the system ground plane 110 is substantially equal to 0.25 wavelength of a central operation frequency of the high-frequency band. According to practical measurements, the antenna system 800 can have an almost omnidirectional radiation pattern and a switchable directional radiation pattern, and it can receive and transmit signals in horizontal and vertical polarization directions.

Figure 9:
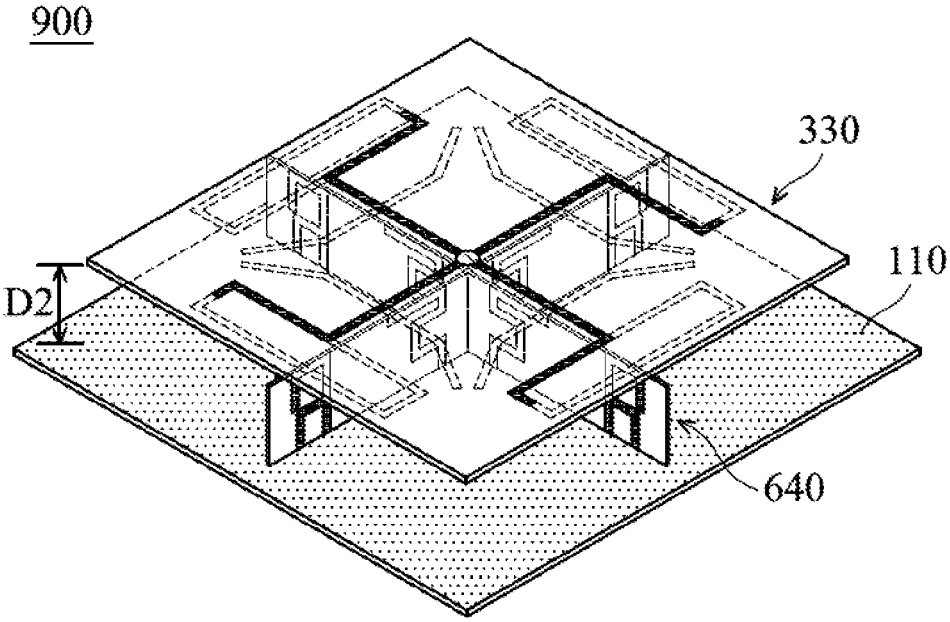
FIG. 9 is a diagram of an antenna system according to an embodiment of the invention.

FIG. 9 is a diagram of an antenna system 900 according to an embodiment of the invention. The antenna system 900 is a combination of the system ground plane 110, the first antenna array 330 (the embodiment of FIG. 3A, FIG. 3B, and FIG. 3C), and the second antenna array 640 (the embodiment of FIG. 6A and FIG. 6B). The first antenna array 330 is substantially parallel to the system ground plane 110. The second antenna array 640 is substantially perpendicular to the system ground plane 110. In comparison to FIG. 8, the first antenna array 330 of FIG. 9 is horizontally rotated by about 45 degrees, and the antenna systems 800 and 900 have almost the same heights. In the embodiment of FIG. 9, the first antenna array 330 and the second antenna array 640 both operate in a low-frequency band from about 2400 MHz to about 2500 MHz. The spacing D2 between the first antenna array 330 and the system ground plane 110 is substantially equal to 0.125 wavelength of a central operation frequency of the low-frequency band. According to practical measurements, the antenna system 900 can have an almost omnidirectional radiation pattern and a switchable directional radiation pattern, and it can receive and transmit signals in horizontal and vertical polarization directions.

It should be noted that the first antenna arrays of FIGS. 2, 3 and 5 may be freely combined with the second antenna arrays of FIGS. 6-7, so as to form a variety of antenna systems, which can have similar levels of performance to those of the embodiments of FIGS. 8-9.

Figure 10A:
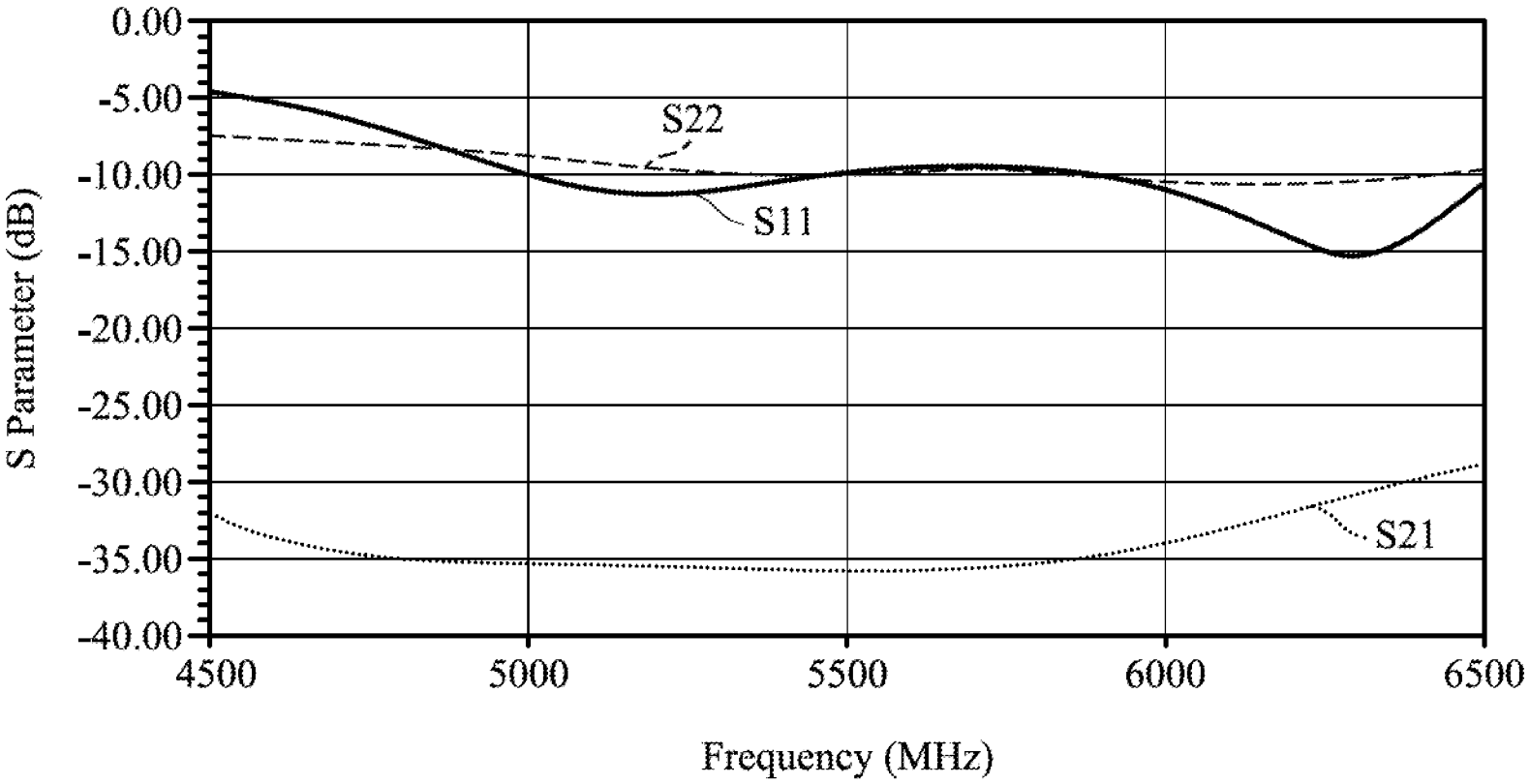
FIG. 10A is a diagram of S parameters of an antenna system operating in a high-frequency band and in an omnidirectional mode, according to an embodiment of the invention.
Figure 10B:
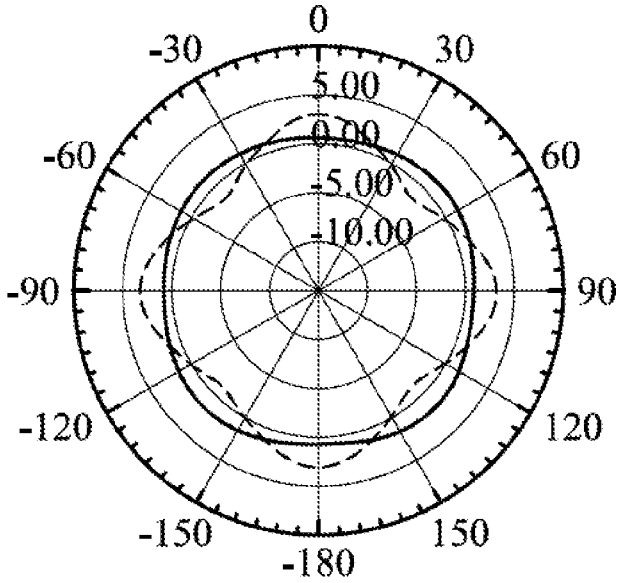
FIG. 10B is a diagram of a first radiation pattern of an antenna system operating in a high-frequency band and in an omnidirectional mode, according to an embodiment of the invention.
Figure 10C:
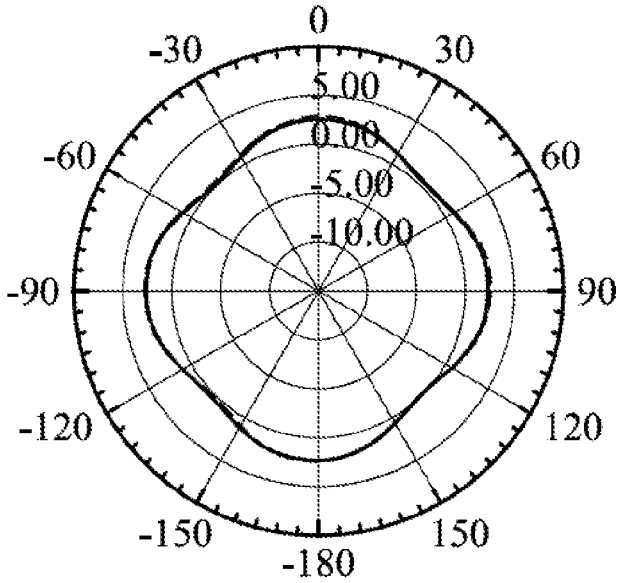
FIG. 10C is a diagram of a second radiation pattern of an antenna system operating in a high-frequency band and in an omnidirectional mode, according to an embodiment of the invention.

FIG. 10A is a diagram of S parameters of the antenna system operating in the high-frequency band and in the omnidirectional mode, according to an embodiment of the invention. FIG. 10B is a diagram of vertical polarized radiation patterns of the antenna system operating in the high-frequency band and in the omnidirectional mode, according to an embodiment of the invention. FIG. 10C is a diagram of horizontal polarized radiation patterns of the antenna system operating in the high-frequency band and in the omnidirectional mode, according to an embodiment of the invention.

Figure 11A:
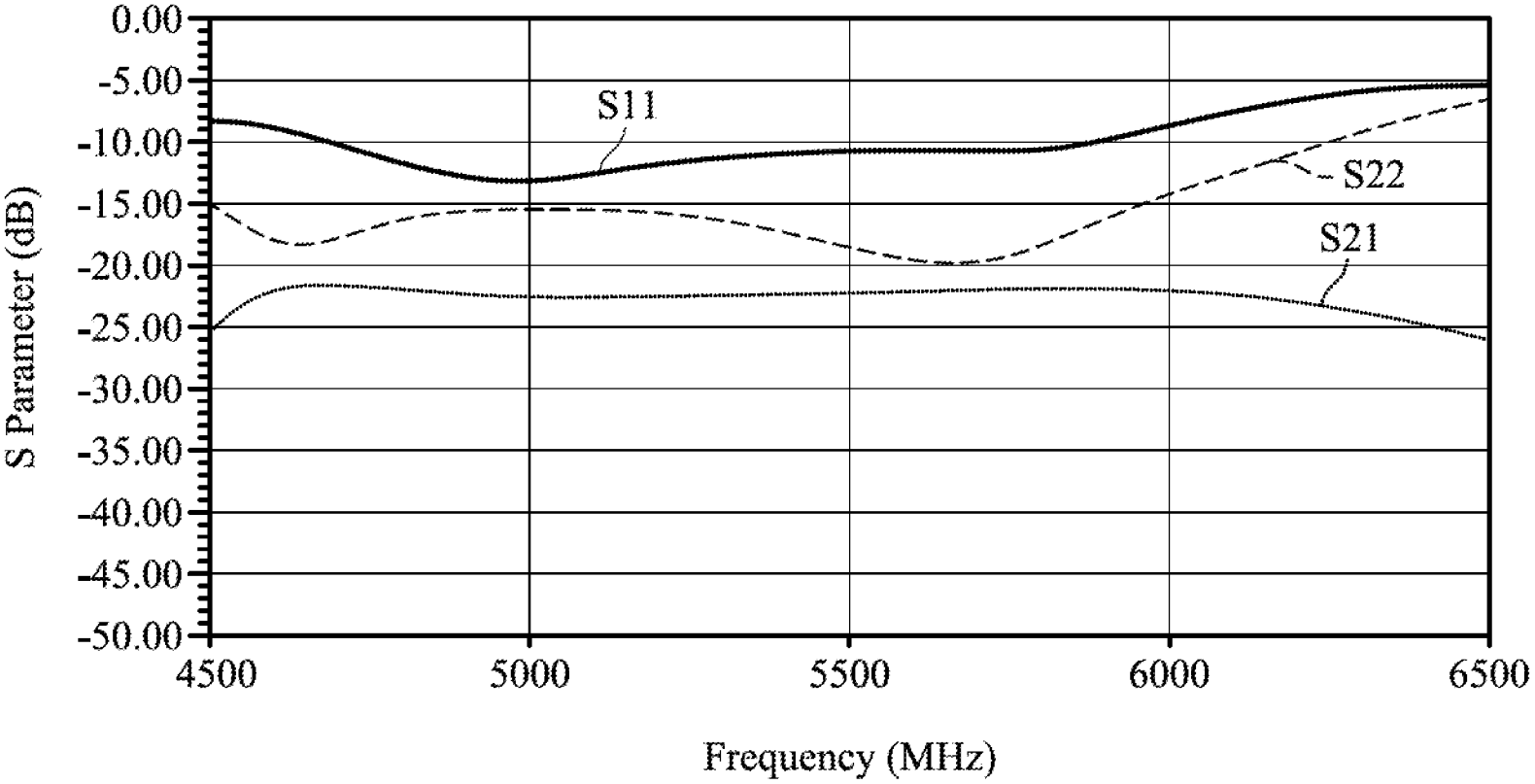
FIG. 11A is a diagram of S parameters of an antenna system operating in a high-frequency band and in a directional mode, according to an embodiment of the invention.
Figure 11B:
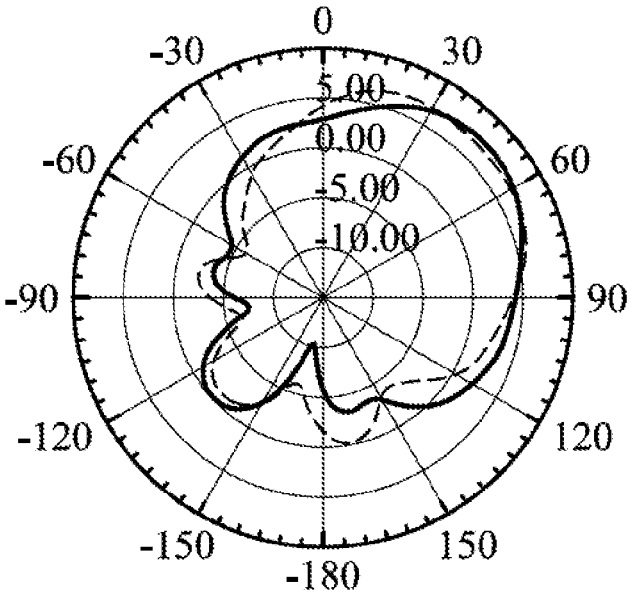
FIG. 11B is a diagram of a first radiation pattern of an antenna system operating in a high-frequency band and in a directional mode, according to an embodiment of the invention.
Figure 11C:
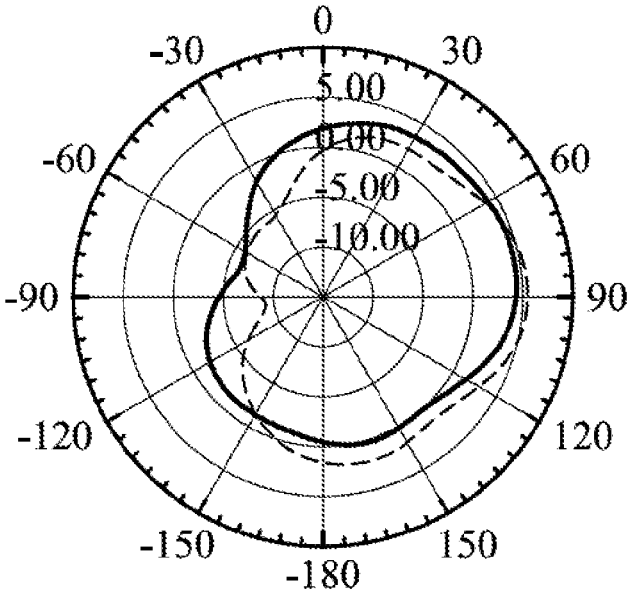
FIG. 11C is a diagram of a second radiation pattern of an antenna system operating in a high-frequency band and in a directional mode, according to an embodiment of the invention.

FIG. 11A is a diagram of S parameters of the antenna system operating in the high-frequency band and in the directional mode, according to an embodiment of the invention. FIG. 11B is a diagram of vertical polarized radiation patterns of the antenna system operating in the high-frequency band and in the directional mode, according to an embodiment of the invention. FIG. 11C is a diagram of horizontal polarized radiation patterns of the antenna system operating in the high-frequency band and in the directional mode, according to an embodiment of the invention.

Figure 12A:
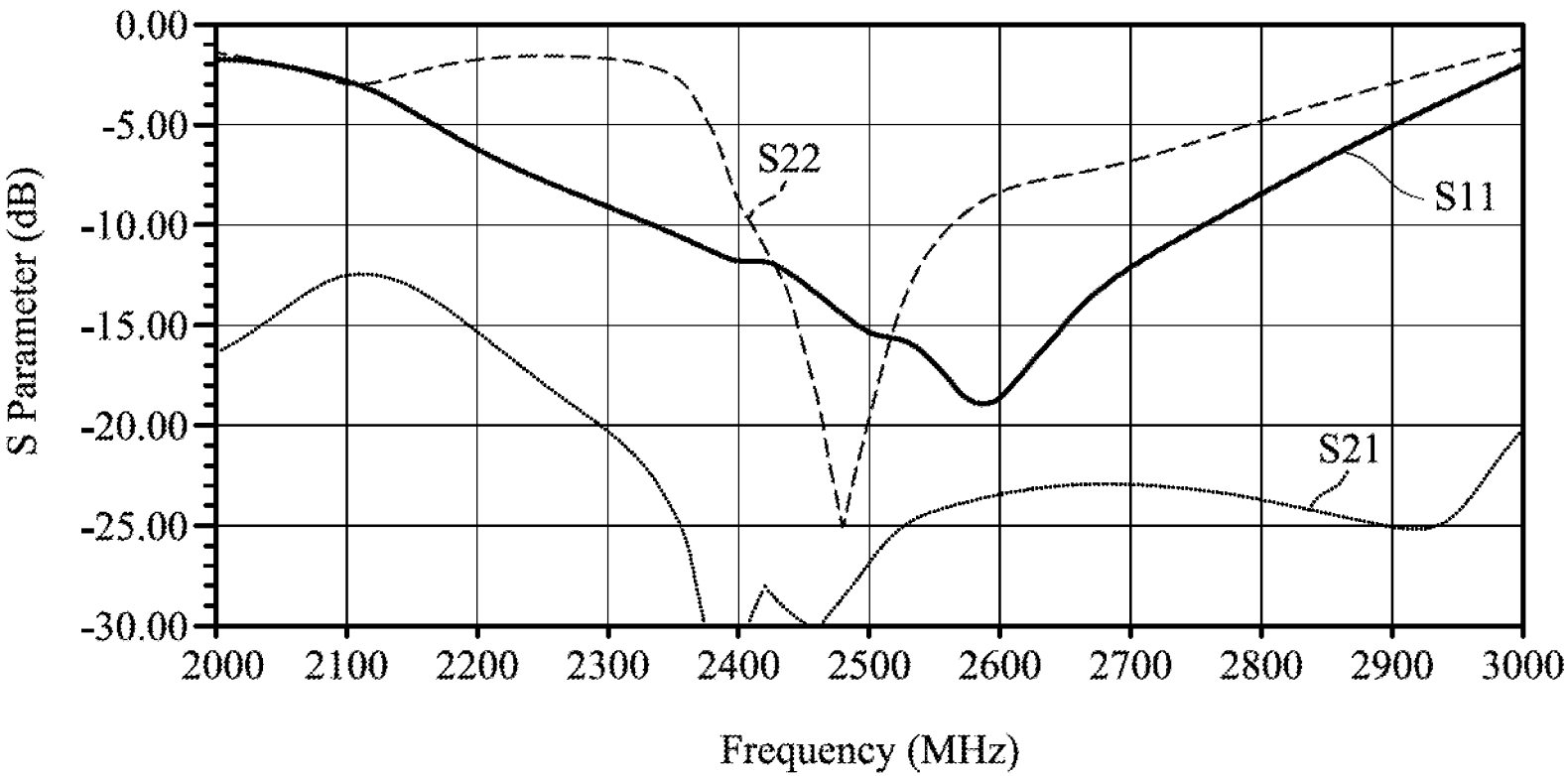
FIG. 12A is a diagram of S parameters of an antenna system operating in a low-frequency band and in an omnidirectional mode, according to an embodiment of the invention.
Figure 12B:
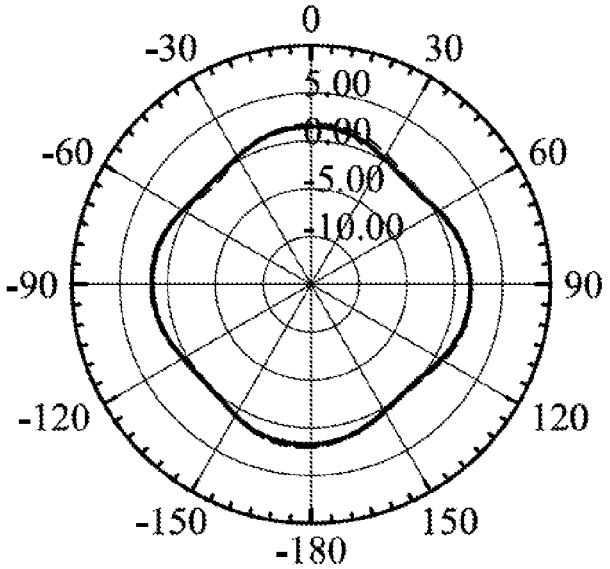
FIG. 12B is a diagram of a first radiation pattern of an antenna system operating in a low-frequency band and in an omnidirectional mode, according to an embodiment of the invention.
Figure 12C:
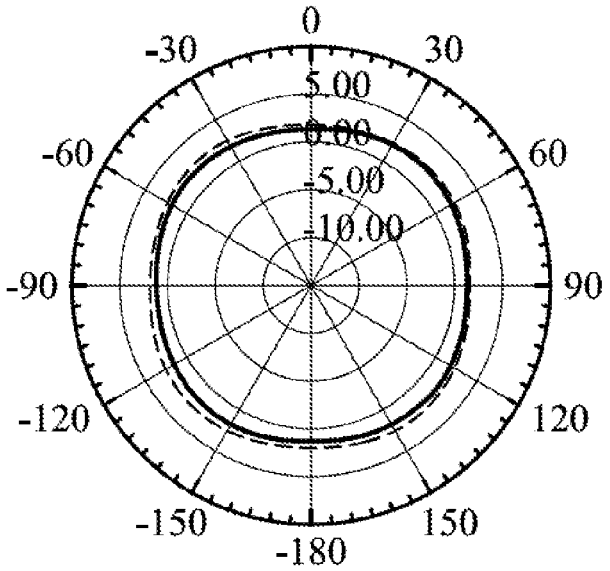
FIG. 12C is a diagram of a second radiation pattern of an antenna system operating in a low-frequency band and in an omnidirectional mode, according to an embodiment of the invention.

FIG. 12A is a diagram of S parameters of the antenna system operating in the low-frequency band and in the omnidirectional mode, according to an embodiment of the invention. FIG. 12B is a diagram of vertical polarized patterns of the antenna system operating in the low-frequency band and in the omnidirectional mode, according to an embodiment of the invention. FIG. 12C is a diagram of horizontal polarized radiation patterns of the antenna system operating in the low-frequency band and in the omnidirectional mode, according to an embodiment of the invention.

Figure 13A:
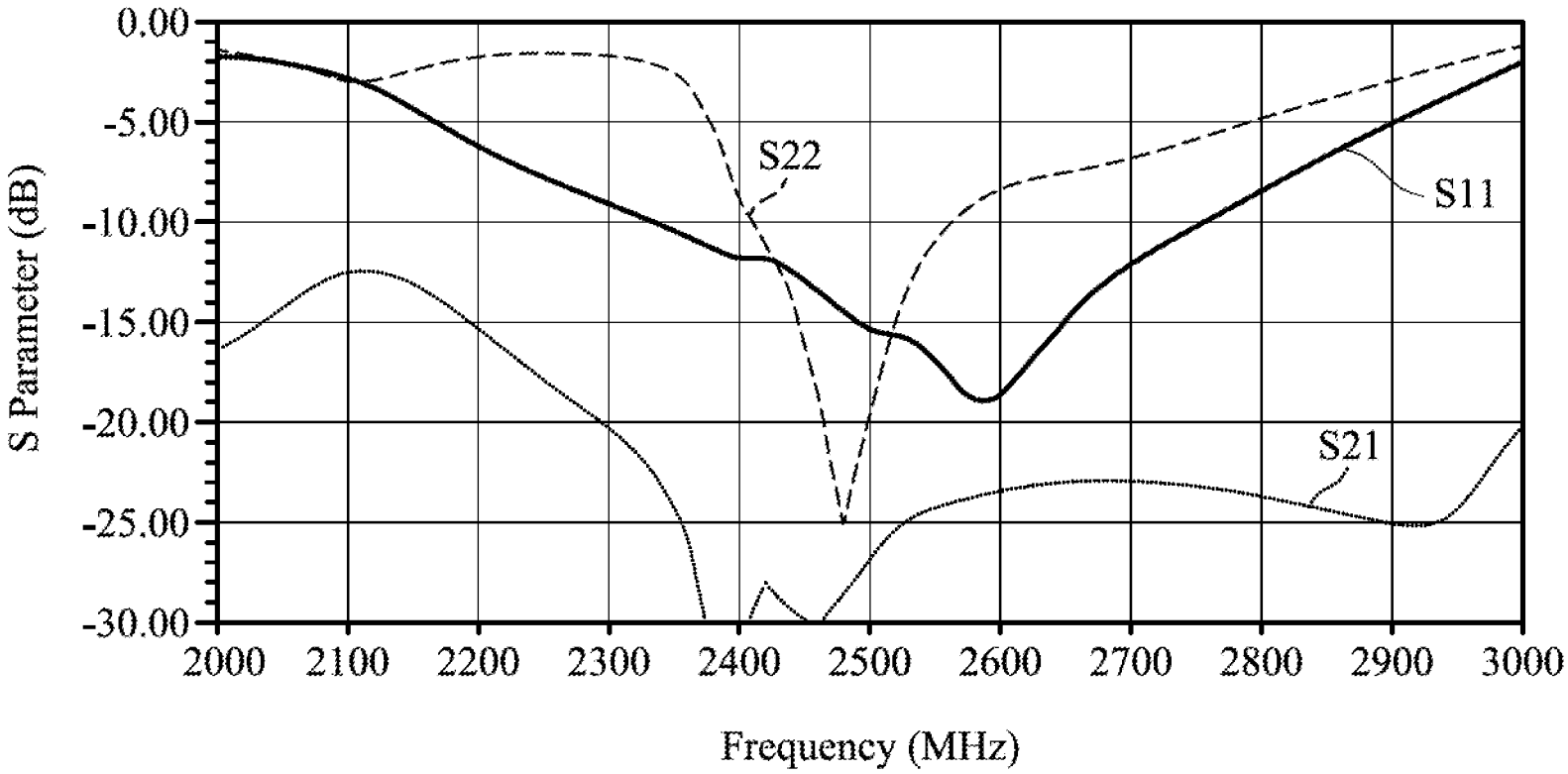
FIG. 13A is a diagram of S parameters of an antenna system operating in a low-frequency band and in a directional mode, according to an embodiment of the invention.
Figure 13B:
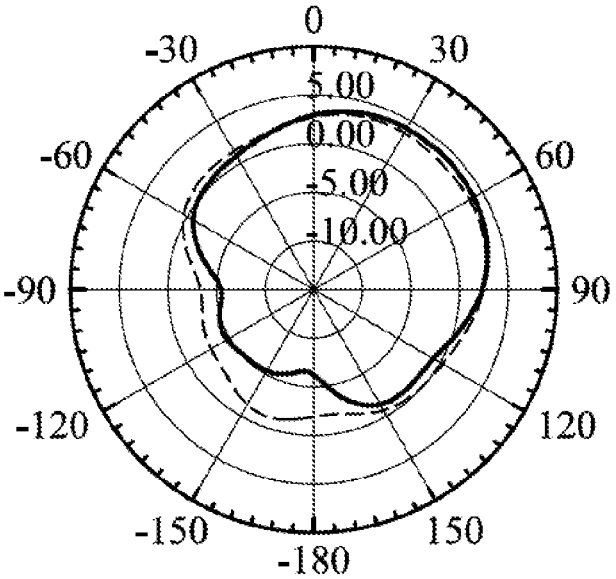
FIG. 13B is a diagram of a first radiation pattern of an antenna system operating in a low-frequency band and in a directional mode, according to an embodiment of the invention.
Figure 13C:
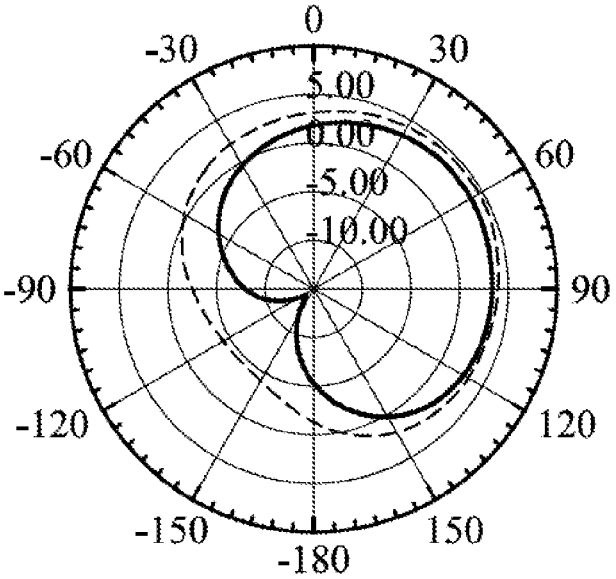
FIG. 13C is a diagram of a second radiation pattern of an antenna system operating in a low-frequency band and in a directional mode, according to an embodiment of the invention.

FIG. 13A is a diagram of S parameters of the antenna system operating in the low-frequency band and in the directional mode, according to an embodiment of the invention. FIG. 13B is a diagram of vertical polarized radiation patterns of the antenna system operating in the low-frequency band and in the directional mode, according to an embodiment of the invention. FIG. 13C is a diagram of horizontal polarized patterns of the antenna system operating in the low-frequency band and in the directional mode, according to an embodiment of the invention.

The invention proposes a 2×2 MIMO (Multi-Input and Multi-Output) antenna system. By arranging horizontally-polarized and vertically-polarized antenna systems around a ring shape, these antenna arrays can achieve an almost omnidirectional radiation pattern for receiving and transmitting signals in a variety of polarization directions concurrently. In addition, if switch circuits are additionally used, the antenna system of the invention can further switch between a directional mode and an omnidirectional mode. The invention is suitable for application in different indoor environments, so as to overcome the drawbacks of the conventional design having poor communication quality due to signal reflection and multipath fading.

Note that the above element sizes, element parameters, element shapes, and frequency ranges are not limitations of the invention. An antenna engineer can adjust these settings or values according to different requirements. It should be understood that the antenna system of the invention is not limited to the configurations of FIGS. 1-9. The invention may merely include any one or more features of any one or more embodiments of FIGS. 1-9. In other words, not all of the features shown in the figures should be implemented in the antenna system of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna system, comprising:

a system ground plane;

a first antenna array, comprising a first antenna element, a second antenna element, a third antenna element, and a fourth antenna element; and a second antenna array, comprising a fifth antenna element, a sixth antenna element, a seventh antenna element, and an eighth antenna element;

wherein the second antenna array is disposed between the first antenna array and the system ground plane;

wherein the first antenna array has a first polarization direction, the second antenna array has a second polarization direction, and the first polarization direction and the second polarization direction are orthogonal to each other;

wherein the antenna system further comprises:

a first substrate;

a second substrate; and a third substrate, wherein the first antenna element, the second antenna element, the third antenna element, and the fourth antenna element are disposed on the first substrate, wherein the fifth antenna element and the seventh antenna element are disposed on the second substrate, wherein the sixth antenna element and the eighth antenna element are disposed on the third substrate, and wherein the first substrate, the second substrate, and the third substrate are perpendicular to each other.

2. The antenna system as claimed in claim 1, wherein the first antenna element, the second antenna element, the third antenna element, and the fourth antenna element have identical structures, and are symmetrical with respect to a central point of the first antenna array.

3. The antenna system as claimed in claim 1, wherein the first antenna element, the second antenna element, the third antenna element, and the fourth antenna element are all dipole antennas.

4. The antenna system as claimed in claim 1, further comprising:

a first square substrate, wherein the first antenna element, the second antenna element, the third antenna element, and the fourth antenna element are respectively disposed at four edges of the first square substrate.

5. The antenna system as claimed in claim 1, wherein the first antenna array further comprises a first director, a second director, a third director, and a fourth director, which are configured to respectively guide electromagnetic waves of the first antenna element, the second antenna element, the third antenna element, and the fourth antenna element outwardly.

6. The antenna system as claimed in claim 1, wherein the first antenna array further comprises a first reflector, a second reflector, a third reflector, and a fourth reflector, which are configured to respectively reflect electromagnetic waves of the first antenna element, the second antenna element, the third antenna element, and the fourth antenna element outwardly.

7. The antenna system as claimed in claim 1, wherein the first antenna element, the second antenna element, the third antenna element, and the fourth antenna element are all folded dipole antennas.

8. The antenna system as claimed in claim 6, wherein the first antenna array further comprises a first switch circuit, a second switch circuit, a third switch circuit, and a fourth switch circuit, such that the first antenna array operates in a directional mode or an omnidirectional mode.

9. The antenna system as claimed in claim 8, wherein the first switch circuit, the second switch circuit, the third switch circuit, and the fourth switch circuit are all PIN diodes.

10. The antenna system as claimed in claim 8, wherein each of the first switch circuit, the second switch circuit, the third switch circuit, and the fourth switch circuit is coupled between a central feeding point and a respective one of the first antenna element, the second antenna element, the third antenna element, and the fourth antenna element.

11. The antenna system as claimed in claim 8, wherein the first switch circuit, the second switch circuit, the third switch circuit, and the fourth switch circuit are respectively embedded in the first reflector, the second reflector, the third reflector, and the fourth reflector.

12. The antenna system as claimed in claim 1, wherein the fifth antenna element, the sixth antenna element, the seventh antenna element, and the eighth antenna element have identical structures, and are symmetrical with respect to a central point of the second antenna array.

13. The antenna system as claimed in claim 1, wherein the fifth antenna element, the sixth antenna element, the seventh antenna element, and the eighth antenna element are all monopole antennas.

14. The antenna system as claimed in claim 1, wherein the fifth antenna element, the sixth antenna element, the seventh antenna element, and the eighth antenna element are all PIFAs (Planar Inverted F Antennas).

15. The antenna system as claimed in claim 1, wherein the second antenna array further comprises a fifth reflector, a sixth reflector, a seventh reflector, and an eighth reflector, which are configured to respectively reflect electromagnetic waves of the fifth antenna element, the sixth antenna element, the seventh antenna element, and the eighth antenna element outwardly.

16. The antenna system as claimed in claim 15, wherein the fifth reflector, the sixth reflector, the seventh reflector, and the eighth reflector are all coupled to the system ground plane.

17. The antenna system as claimed in claim 1, wherein the first antenna array is substantially parallel to the system ground plane, and the second antenna array is substantially perpendicular to the system ground plane.

18. The antenna system as claimed in claim 17, wherein the first antenna array and the second antenna array operate in a low-frequency band from 2400 MHz to 2500 MHz, and wherein spacing between the first antenna array and the system ground plane is substantially equal to 0.125 wavelength of a central operation frequency of the low-frequency band.

19. The antenna system as claimed in claim 17, wherein the first antenna array and the second antenna array operate in a high-frequency band from 4900 MHz to 5950 MHz, and wherein spacing between the first antenna array and the system ground plane is substantially equal to 0.25 wavelength of a central operation frequency of the high-frequency band.

* * * * *